US009069314B2

(12) United States Patent
Fujiwara

(10) Patent No.: US 9,069,314 B2
(45) Date of Patent: Jun. 30, 2015

(54) IMAGE FORMING APPARATUS WITH INCREASED DEVELOPMENT EFFICIENCY AND CONTROL METHOD

(75) Inventor: Motohiro Fujiwara, Haar (DE)

(73) Assignee: CANON KABUSHIKI KAISHA (JP)

( * ) Notice: Subject to any disclaimer, the term of this patent is extended or adjusted under 35 U.S.C. 154(b) by 180 days.

(21) Appl. No.: 13/348,669

(22) Filed: Jan. 12, 2012

(65) Prior Publication Data

US 2012/0183315 A1 Jul. 19, 2012

(30) Foreign Application Priority Data

Jan. 19, 2011 (JP) ..... 2011-009197

(51) Int. Cl.
*G03G 15/00* (2006.01)
*G03G 15/08* (2006.01)

(52) U.S. Cl.
CPC ..... *G03G 15/5041* (2013.01); *G03G 15/5058* (2013.01); *G03G 15/0855* (2013.01)

(58) Field of Classification Search
USPC ..... 399/38, 42, 50, 51, 53, 55, 58, 59, 60, 399/72, 406
See application file for complete search history.

(56) References Cited

U.S. PATENT DOCUMENTS

| | | | | |
|---|---|---|---|---|
| 5,469,244 | A * | 11/1995 | Ogata et al. | 399/30 |
| 5,574,543 | A * | 11/1996 | Sakai et al. | 399/59 |
| 7,050,729 | B2 * | 5/2006 | Fujiwara | 399/27 |
| 2004/0101322 | A1 * | 5/2004 | Tsukida et al. | 399/27 |
| 2006/0018674 | A1 * | 1/2006 | Hirata et al. | 399/29 |
| 2008/0206661 | A1 * | 8/2008 | Fujishima et al. | 430/48 |
| 2010/0061750 | A1 | 3/2010 | Okada | |
| 2011/0164888 | A1 * | 7/2011 | Kubo et al. | 399/27 |
| 2011/0280600 | A1 * | 11/2011 | Suzuki | 399/44 |
| 2014/0348525 | A1 * | 11/2014 | Minegishi et al. | 399/51 |

FOREIGN PATENT DOCUMENTS

| | | | |
|---|---|---|---|
| CN | 2736811 | Y | 10/2005 |
| CN | 101482710 | A | 7/2009 |

(Continued)

OTHER PUBLICATIONS

Chinese Office Action issued in Chinese counterpart application No. CN2012100203238, dated Jun. 13, 2013. English translation provided.

*Primary Examiner* — Clayton E Laballe
*Assistant Examiner* — Victor Verbitsky
(74) *Attorney, Agent, or Firm* — Rossi, Kimms & McDowell LLP

(57) ABSTRACT

An image forming apparatus which forms an image on an image carrier along with rotation of a developing sleeve that carries a toner and carrier contained in a two-component developer, comprises: forming unit configured to form a density detection toner image on the image carrier using the toner; detection unit configured to detect a density of the density detection toner image formed; prediction unit configured to predict a toner charge amount in the two-component developer; correction unit configured to correct the toner charge amount in the two-component developer using a value obtained from a relationship between the toner charge amount predicted by the prediction unit and the density of the toner image that is detected by the detection unit; and control unit configured, when forming the density detection toner image by the forming unit, to control to increase a development efficiency, compared to image formation based on image data.

7 Claims, 12 Drawing Sheets

(56) References Cited

FOREIGN PATENT DOCUMENTS

| | | | |
|---|---|---|---|
| JP | 11-212343 | A | 8/1999 |
| JP | 2000321833 | A | 11/2000 |
| JP | 2003295598 | A | 10/2003 |

* cited by examiner

IMAGE FORMING APPARATUS WITH INCREASED DEVELOPMENT EFFICIENCY AND CONTROL METHOD

BACKGROUND OF THE INVENTION

1. Field of the Invention

The present invention relates to an electrophotographic image forming apparatus and control method thereof and, more particularly, to an image forming apparatus which prevents variations of the density and tint and a control method thereof.

2. Description of the Related Art

A developing device in an image forming apparatus of an electrophotographic type or electrostatic printing type generally adopts a two-component developer mainly containing toner particles and carrier particles. Especially, most developing devices in color image forming apparatuses for forming a full-color or multi-color image use a two-component developer. The toner density (that is, the ratio of the weight of toner particles to the total weight of carrier particles and toner particles) of the two-component developer is a very important factor to stabilize the image quality.

The toner particles of the two-component developer are consumed in development and the toner density changes to decrease. Considering this, the toner density of the two-component developer is controlled constant by detecting the toner density of the two-component developer in the developing device, and controlling toner replenishment to the developing device in accordance with the detected toner density. However, the electrophotographic method and electrostatic printing method form an image using electrostatic force. If the charge amount (to be referred to as toner charge amount) in the two-component developer varies, the image density also varies.

To solve this problem, Japanese Patent Laid-Open No. 11-212343 has proposed control of estimating a change of the toner charge amount from the standstill time and humidity environment, and stirring the developer in accordance with the estimation result to stabilize the image density.

However, a predicted toner charge amount may deviate from an actual one by only feedforward prediction of the toner charge amount as in Japanese Patent Laid-Open No. 11-212343. The need arises for toner charge amount observer correction using feedback. An example of the feedback is control of creating a test pattern image (to be referred to as a patch image), detecting the density, and correcting the toner charge amount. However, the patch image density is determined not only by the toner charge amount but also by the development efficiency, so only the toner charge amount cannot be detected. It is therefore difficult to predict the toner charge amount from the patch image.

SUMMARY OF THE INVENTION

The present invention proposes appropriate feedback control of the toner charge amount and therefore provides an image forming apparatus capable of obtaining a stable density and tint transition.

According to one aspect of the present invention, there is provided an image forming apparatus which forms, based on image data, an image on an image carrier along with rotation of a developing sleeve that carries a toner and carrier contained in a two-component developer, comprising: forming unit configured to form a density detection toner image on the image carrier using the toner carried by the developing sleeve; detection unit configured to detect a density of the density detection toner image formed by the forming unit; prediction unit configured to predict a toner charge amount in the two-component developer; correction unit configured to correct the toner charge amount in the two-component developer using a value obtained from a relationship between the toner charge amount predicted by the prediction unit and the density of the toner image that is detected by the detection unit; and control unit configured, when forming the density detection toner image by the forming unit, to control to increase a development efficiency, compared to image formation based on image data.

According to another aspect of the present invention, there is provided a method of controlling an image forming apparatus which forms, based on image data, an image on an image carrier along with rotation of a developing sleeve that carries a toner and carrier contained in a two-component developer, comprising: a forming step of forming a density detection toner image on the image carrier using the toner carried by the developing sleeve; a detection step of detecting a density of the density detection toner image formed in the forming step; a prediction step of predicting a toner charge amount in the two-component developer; a correction step of correcting the toner charge amount in the two-component developer using a value obtained from a relationship between the toner charge amount predicted in the prediction step and the density of the toner image that is detected in the detection step; and a control step of, when forming the density detection toner image in the forming step, controlling to increase a development efficiency, compared to image formation based on image data.

According to the present invention, the toner charge amount can be reliably detected from a patch image by increasing the development efficiency and detecting a patch. Based on the detection result, observer correction of a predicted toner charge amount is performed. A high-quality image with a constant image density can be formed stably.

Further features of the present invention will become apparent from the following description of exemplary embodiments (with reference to the attached drawings).

DESCRIPTION OF THE EMBODIMENTS

First Embodiment

The first embodiment of the present invention will now be described in detail with reference to the accompanying drawings. The present invention can be practiced even in another embodiment which replaces part or all of the arrangement of the embodiment with an alternative arrangement as long as a predicted toner charge amount in a two-component developer is controlled in accordance with the result of detecting a patch while increasing the development efficiency.

The present invention can therefore be practiced regardless of a tandem type/single-drum type or an intermediate transfer type/direct transfer type as long as an image forming apparatus forms an image using the electrophotographic method. The embodiment will describe only a main part concerning formation and transfer of a toner image. However, the present invention is practiced for various application purposes in a printer, various printing apparatuses, copying machine, FAX, multi-function peripheral, and the like by adding a necessary device, equipment, or housing structure.

[Image Forming Apparatus]

Figure 1:
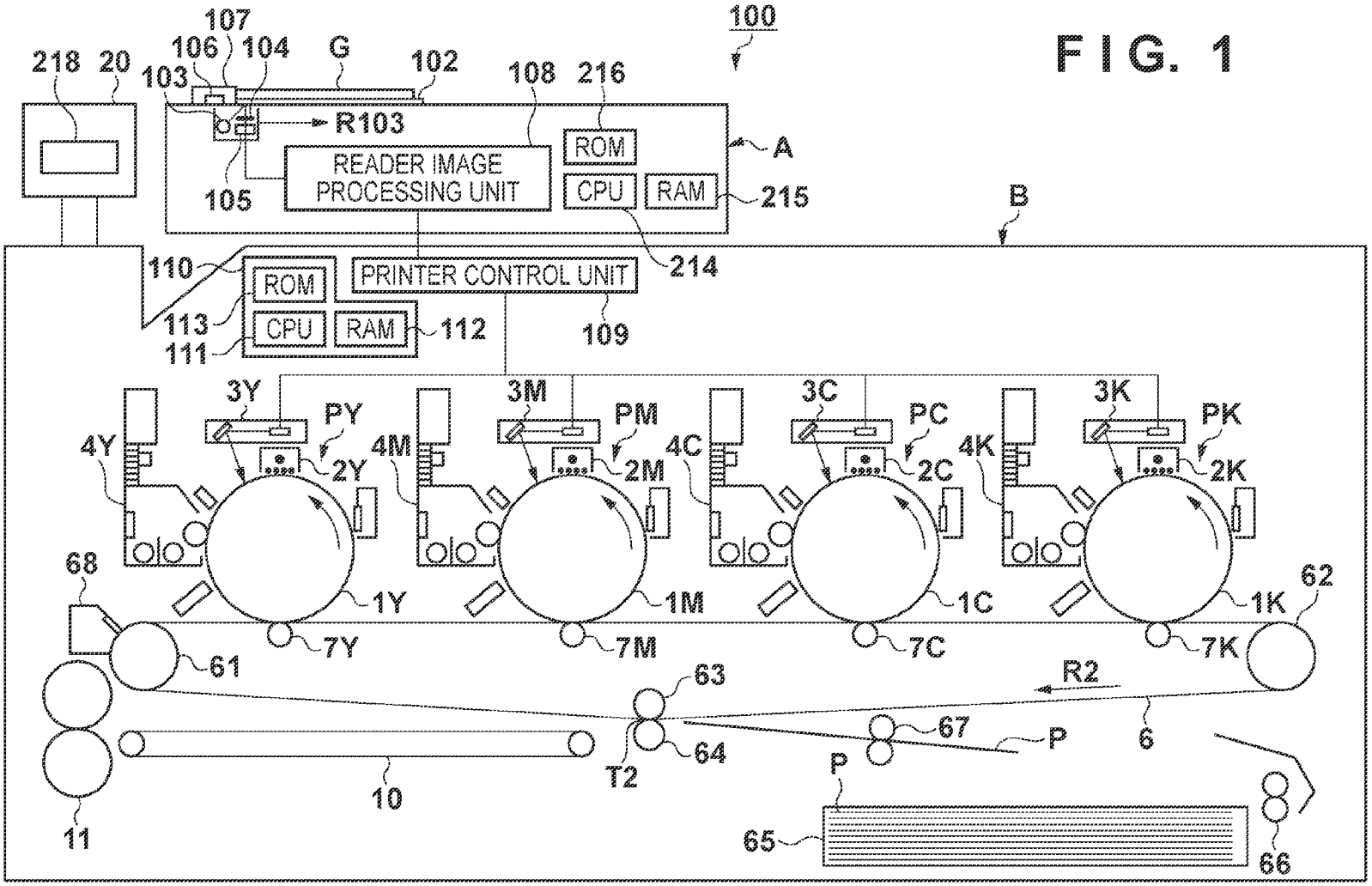
FIG. 1 is a sectional view for explaining the arrangement of an image forming apparatus.

FIG. 1 is a sectional view for explaining the arrangement of an image forming apparatus. An image forming apparatus 100 is a tandem intermediate transfer full-color printer in which yellow (Y), magenta (M), cyan (C), and black (K) image forming units PY, PM, PC, and PK are arrayed along an intermediate transfer belt 6.

The image forming unit PY forms a yellow toner image on a photosensitive drum 1Y serving as an image carrier, and primarily transfers it onto the intermediate transfer belt 6. The image forming unit PM forms a magenta toner image on a photosensitive drum 1M and primarily transfers it to overlap the yellow toner image on the intermediate transfer belt 6. The image forming units PC and PK form cyan and black toner images on photosensitive drums 1C and 1K respectively, and primarily transfer them sequentially onto the intermediate transfer belt 6. At this time, assume that each photosensitive drum rotates in a direction indicated by an arrow shown in FIG. 1.

The toner images of the four colors primarily transferred on the intermediate transfer belt 6 are conveyed to a secondary transfer portion T2, and secondarily transferred onto a printing medium P at once. The printing medium P bearing the secondarily transferred toner images of the four colors is heated and pressed by a fixing device 11 to fix the toner images onto the surface. Then, the printing medium P is discharged from the apparatus.

The intermediate transfer belt 6 is looped between a tension roller 61, driving roller 62, and counter roller 63 and supported by them. The intermediate transfer belt 6 is driven by the driving roller 62 to rotate in a direction indicated by an arrow R2 at a predetermined process speed.

Printing media P picked up from a printing medium cassette 65 are separated one by one by a separation roller 66, and each printing medium P is sent to registration rollers 67. When the registration rollers 67 stop, they accept and hold the printing medium P, and supply it to the secondary transfer portion T2 in synchronism with the timing of a toner image on the intermediate transfer belt 6.

A secondary transfer roller 64 is in contact with the intermediate transfer belt 6 supported by the counter roller 63, and forms the secondary transfer portion T2. By applying a positive DC voltage to the secondary transfer roller 64, the toner image which is negatively charged and carried by the intermediate transfer belt 6 is secondarily transferred to the printing medium P.

The image forming units PY, PM, PC, and PK have almost the same arrangement except that the colors of toners used in developing devices 4Y, 4M, 4C, and 4K are yellow, magenta, cyan, and black, respectively. In the following description, when the image forming units PY, PM, PC, and PK need not be discriminated, the suffices "Y", "M", "C", and "K" to reference numerals to indicate the respective colors will be omitted, and the image forming unit will be explained comprehensively.

Figure 4:
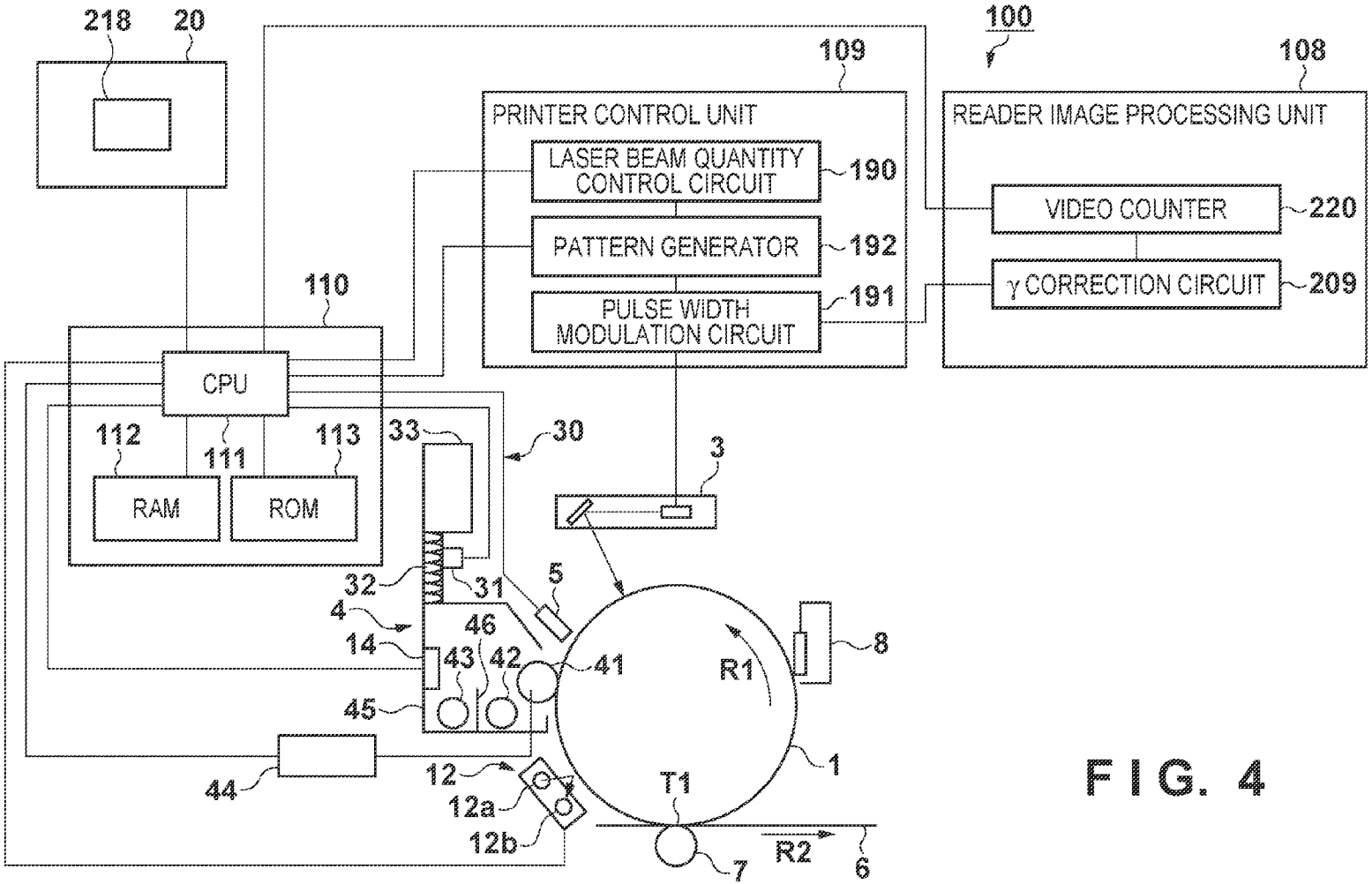
FIG. 4 is a block diagram showing the control system of an image forming unit.

FIG. 4 is a view showing each image forming unit in FIG. 1 in more detail. The image forming unit will be described in detail with reference to FIGS. 1 and 4. In the image forming unit, a charging device 2, exposure device 3, developing device 4, primary transfer roller 7, and cleaning device 8 are laid out around a photosensitive drum 1.

The photosensitive drum 1 is configured by forming a photosensitive layer with the negative charge polarity on the outer surface of an aluminum cylinder. The photosensitive drum 1 rotates in a direction indicated by an arrow R1 at a predetermined process speed. The photosensitive drum 1 is, for example, an OPC photosensitive body whose reflectance of near infrared light (960 nm) is about 40%. However, the photosensitive drum 1 may be an amorphous silicon-related photosensitive body having almost the same reflectance.

The charging device 2 uses a scorotron charger. The charging device 2 irradiates the photosensitive drum 1 with charged particles upon corona discharge to charge the surface of the photosensitive drum 1 at a uniform negative potential. The scorotron charger includes a wire to which a high voltage is applied, a grounded shield portion, and a grid portion to which a desired voltage is applied. A predetermined charge bias is applied from a charge bias power supply (not shown) to the wire of the charging device 2. A predetermined grid bias is applied from a grid bias power supply (not shown) to the grid portion of the charging device 2. The photosensitive drum 1 is charged to almost the voltage applied to the grid portion though it depends on the voltage applied to the wire.

The exposure device 3 scans a laser beam using a rotating mirror to write the electrostatic image of an image on the surface of the charged photosensitive drum 1. A potential sensor 5 serving as an example of a potential detection means can detect the potential of an electrostatic image formed on the photosensitive drum 1 by the exposure device 3. The developing device 4 applies the toner to the electrostatic image on the photosensitive drum 1, developing the electrostatic image into a toner image.

The primary transfer roller 7 presses the inner surface of the intermediate transfer belt 6 to form a primary transfer portion T1 between the photosensitive drum 1 and the intermediate transfer belt 6. When a positive DC voltage is applied to the primary transfer roller 7, the negative toner image carried on the photosensitive drum 1 is primarily transferred to the intermediate transfer belt 6 passing through the primary transfer portion T1.

The cleaning device 8 rubs the photosensitive drum 1 with a cleaning blade to recover a toner which has not been transferred to the intermediate transfer belt 6 and remains on the photosensitive drum 1.

A belt cleaning device 68 rubs the intermediate transfer belt 6 with a cleaning blade to recover a toner which has not been transferred to the printing medium P and remains on the intermediate transfer belt 6 after passing through the secondary transfer portion T2.

The image forming apparatus 100 includes an operation unit 20. The image forming apparatus 100 according to the embodiment also includes an image reading unit A and printer unit B. The operation unit 20 includes a display 218. The operation unit 20 is connected to a CPU 214 of the image reading unit A and a control unit 110 of the image forming apparatus 100. The user can input various conditions such as the image type and sheet count via the operation unit 20. The printer unit B forms an image under the input conditions.

[Image Reading Unit]

Figure 2:
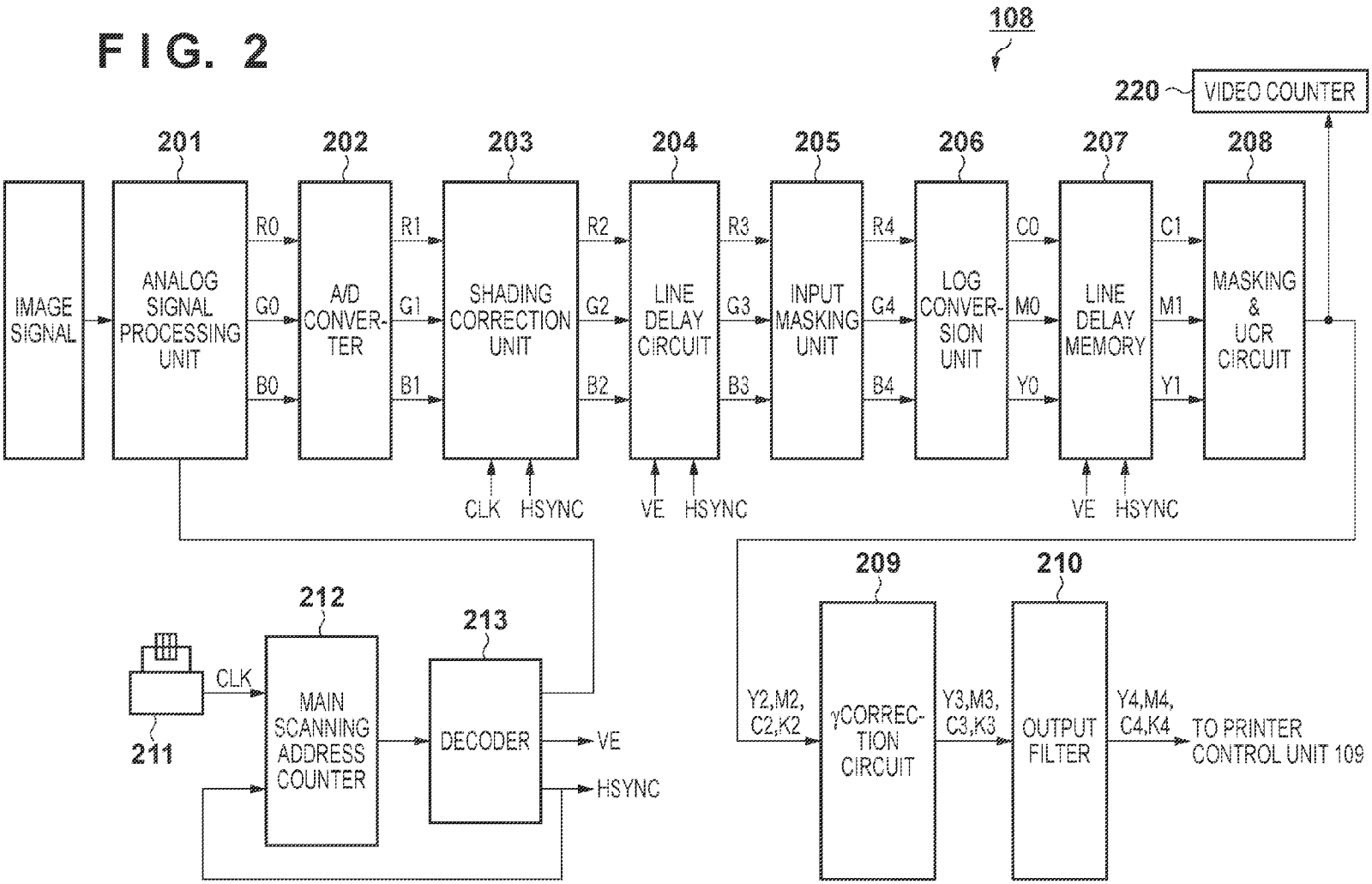
FIG. 2 is a block diagram showing signal processing in a reader image processing unit.
Figure 3:
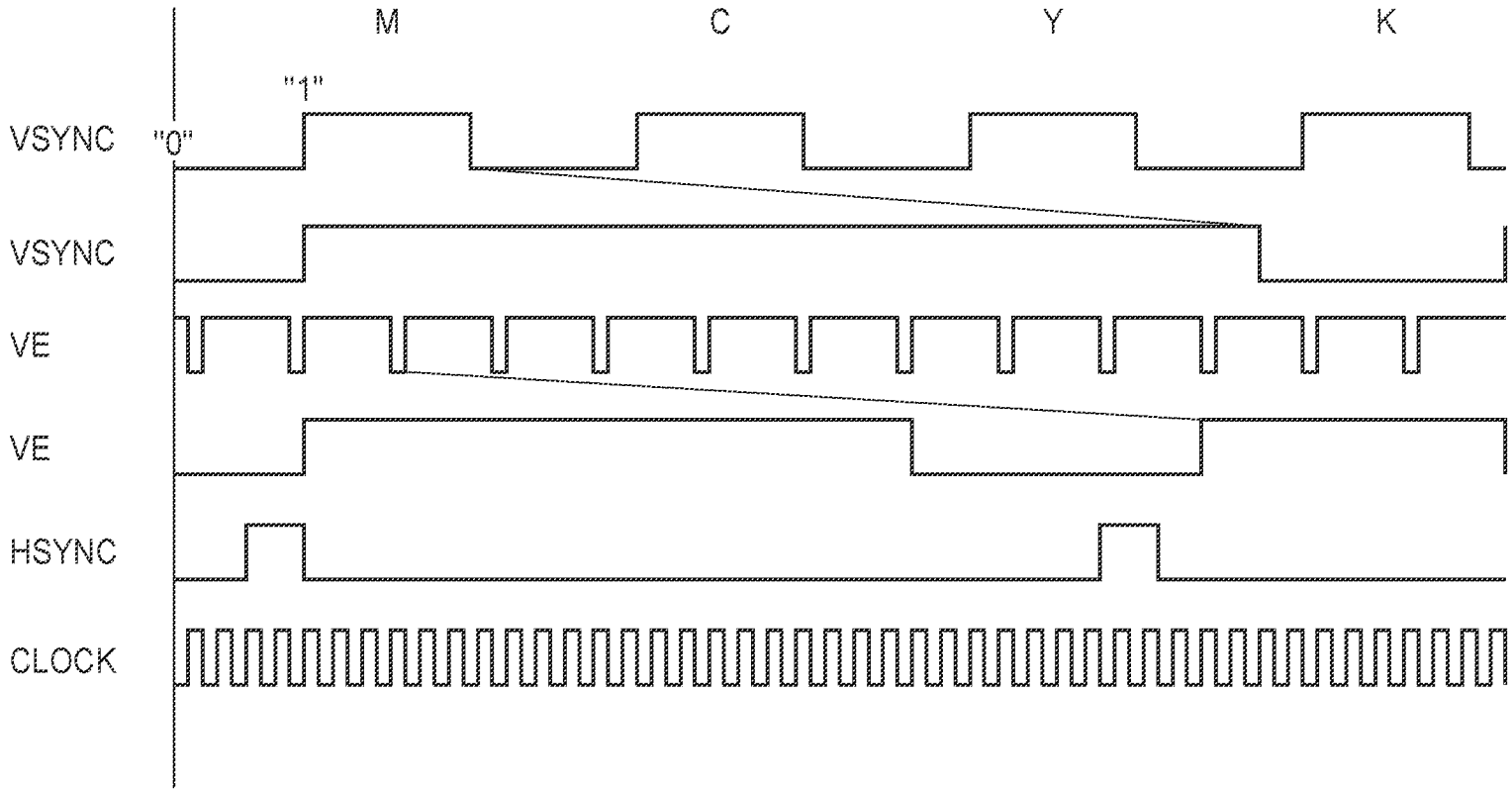
FIG. 3 is a timing chart for explaining the timings of control signals in the reader image processing unit.

FIG. 2 is a block diagram showing signal processing in a reader image processing unit 108 of the image reading unit A. FIG. 3 is a timing chart for explaining the timings of control signals in the reader image processing unit 108.

As shown in FIG. 1, the image reading unit (reader unit) A reads an image on a face-down surface (on the side of an original platen glass 102) of an original G set on the original platen glass 102. The image of the original G is irradiated by a light source 103 and formed on a CCD sensor 105 via an optical system 104. The CCD sensor 105 generates red (R), green (G), and blue (B) color component signals using R, G, and B CCD line sensors arrayed in three lines. An optical system unit including the light source 103, optical system 104, and CCD sensor 105 moves in a direction indicated by an arrow R103 to read the image of the original G and convert it into an electrical signal data string of each line.

An abutting member 107 is arranged on the original platen glass 102 to position the original G by abutment. A reference white plate 106 is laid out on the original platen glass 102 to determine the white level of the CCD sensor 105 and perform shading of the CCD sensor 105 in the thrust direction.

An image signal obtained by the CCD sensor 105 undergoes image processing by the reader image processing unit 108, is sent to a printer control unit (printer image processing unit) 109, and further undergoes image processing.

As shown in FIG. 2, a clock generation unit 211 generates a clock (CLOCK signal) for each pixel. A main scanning address counter 212 generates a main scanning address for each pixel of one line by counting clocks from the clock generation unit 211. The main scanning address counter 212 is cleared in response to an HSYNC signal, and starts counting the main scanning address of the next line.

A decoder 213 decodes a main scanning address from the main scanning address counter 212, and generates a CCD driving signal such as a shift pulse or reset pulse for each line. Also, the decoder 213 generates a VE signal indicating an effective region in the I-line reading signal of the CCD sensor 105, and a line sync signal HSYNC.

As shown in FIG. 3, a VSYNC signal is an image effective section signal in the sub-scanning direction. The VSYNC signal is used to read (scan) an image in the logic "1" section and form M, C, Y, and K output signals sequentially. The VE signal is an image effective section signal in the main scanning direction. The VE signal is used to adjust the timing of the main scanning start position in the logic "1" section, and is mainly used in line count control for a line delay. A CLOCK signal is a pixel sync signal and is used to transfer image data of one pixel at a leading edge from "0" to "1".

As shown in FIG. 2, an image signal output from the CCD sensor 105 is input to an analog signal processing unit 201. The analog signal processing unit 201 performs gain adjustment and offset adjustment for the input signal. Then, an A/D converter 202 converts the respective color signals into 8-bit digital image signals R1, G1, and B1. A shading correction unit 203 receives the digital image signals R1, G1, and B1, and performs shading correction for the respective colors using the reading signal of the reference white plate 106.

The respective line sensors of the CCD sensor 105 are laid out at a predetermined distance between R, G, and B. A line delay circuit 204 corrects spatial shifts between digital image signals R2, G2, and B2 in the sub-scanning direction. More specifically, the line delay circuit 204 line-delays the R and G signals in the sub-scanning direction to adjust them to the B signal.

An input masking unit 205 converts a reading color space determined by the spectral characteristics of the R, G, and B filters of the CCD sensor 105 into an NTSC standard color space by executing matrix calculation given by the following equation:

$$\begin{bmatrix} R4 \\ G4 \\ B4 \end{bmatrix} = \begin{bmatrix} a11 & a12 & a13 \\ a21 & a22 & a23 \\ a31 & a32 & a33 \end{bmatrix} \begin{bmatrix} R3 \\ G3 \\ B3 \end{bmatrix}$$

A light quantity/image density conversion unit (LOG conversion unit) 206 includes a lookup table (LUT) ROM, and converts luminance signals R4, G4, and B4 into density signals M0, C0, and Y0 serving as image signals of M, C, and Y colors by using the stored LUT. A line delay memory 207 delays the image signals M0, C0, and Y0 by a line delay till determination signals such as UCR, FILTER, and SEN generated from the signals R4, G4, and B4 by a black character determination unit (not shown) (M1, C1, and Y1).

A masking & UCR circuit 208 extracts a black (K) signal from the input three primary color signals M1, C1, and Y1. Further, the masking & UCR circuit 208 performs calculation to correct the color turbidity of a printing color material in the printer unit B. The masking & UCR circuit 208 outputs signals M2, C2, Y2, and K2 sequentially at a predetermined bit width (8 bits) in every reading operation.

A γ correction circuit 209 corrects the image density in the reader unit A to adjust the input image signals M2, C2, Y2, and K2 to an ideal tone characteristic of the printer unit B. The γ correction circuit 209 executes density conversion using a gamma correction LUT (tone correction table) formed from a 256-byte RAM or the like (M3, C3, Y3, and K3). A spatial filter processing unit (output filter) 210 performs edge emphasis or smoothing processing for the image signals M3, C3, Y3, and K3 input from the γ correction circuit 209. The spatial filter processing unit 210 outputs processed image signals M4, C4, Y4, and K4 to the printer control unit 109.

[Control Unit]

FIG. 4 is a block diagram showing the control system of the image forming unit. As shown in FIG. 4, the image forming apparatus 100 includes the control unit 110 which comprehensively controls the image forming operation. The control unit 110 includes a CPU 111, RAM 112, and ROM 113.

The exposure device 3 includes a laser scanner with a rotating mirror. A laser beam quantity control circuit 190 determines an exposure output from the exposure device 3 so that a desired image density level can be obtained in accordance with a laser output signal. The exposure device 3 emits a binary laser beam at a pulse width determined by a pulse width modulation circuit 191 in accordance with a driving signal generated based on the tone correction table (LUT) of the γ correction circuit 209.

The γ correction circuit 209 stores, as the tone correction table (LUT), a laser output signal capable of forming a desired image density from the relationship between the laser output signal and the image density level that is obtained in advance. The laser output signal is determined according to the tone correction table.

The frame-sequential image signals M4, C4, Y4, and K4 processed by the spatial filter processing unit 210 shown in FIG. 2 are sent to the printer control unit 109. The exposure device 3 then executes image printing with a density level by binary area coverage modulation using PWM (Pulse Width Modulation).

That is, for every input pixel image signal, the pulse width modulation circuit 191 of the printer control unit 109 forms and outputs a laser driving pulse of a width (time width) corresponding to the level of the signal. The pulse width modulation circuit 191 forms a large-width driving pulse for a high-density pixel image signal, a small-width driving pulse for a low-density pixel image signal, and an intermediate-width driving pulse for an intermediate-density pixel image signal.

A binary laser driving pulse output from the pulse width modulation circuit 191 is supplied to the semiconductor laser of the exposure device 3, and causes the semiconductor laser to emit light for the time corresponding to the pulse width. The semiconductor laser is driven for a long time for a high-density pixel and a short time for a low-density pixel.

The dot size (area) of an electrostatic image formed on the photosensitive drum 1 changes in correspondence with the pixel density. The exposure device 3 exposes a long range in the main scanning direction for a high-density pixel and a short range in the main scanning direction for a low-density pixel. As a matter of course, a toner consumption amount corresponding to a high-density pixel is larger than that for a low-density pixel.

[Developing Device]

The developing device 4 employs a two-component developing method using a two-component developer prepared by mixing a magnetic carrier in a nonmagnetic toner. The nonmagnetic toner (to be referred to as toner) is prepared by dispersing a color material of each color using a styrene-based copolymer resin as a binder, and the average particle size is 5 μm. The developing device 4 stirs the two-component developer to charge the magnetic carrier positively and the toner negatively.

In the developing device 4, the space in a developing vessel 45 is partitioned into the first room (developing room) and the second room (stirring room) by a partition 46 extending in a direction perpendicular to the sheet surface. In the first room, a nonmagnetic developing sleeve 41 is laid out, and a magnet is permanently laid out as a magnetic field generation means in the developing sleeve 41.

In the first room, a first screw 42 is laid out to stir and convey the developer in the first room. In the second room, a second screw 43 is laid out to convey the developer in a direction opposite to that by the first screw 42 while stirring the developer in the second room. The second screw 43 uniforms the toner density of the developer by stirring, together with the developer already present in the developing device 4, the toner supplied from a toner replenishment bath 33 along with rotation of a toner conveyance screw 32.

The partition 46 has a pair of developer passages at ends on near and far sides with respect to the sheet surface so that the first and second rooms communicate with each other. By the conveyance forces of the first screw 42 and second screw 43, the developer is stirred and circulates through the pair of developer passages within the developing vessel 45. The developer in the first room, whose toner is consumed by development to decrease the toner density, moves to the second room through one developer passage. The developer recovers the toner density by toner replenishment in the second room, and moves into the first room through the other developer passage.

The two-component developer in the first room is applied to the developing sleeve 41 by the first screw 42, and carried with carrier chain formation on the developing sleeve 41 by the magnetic force of the magnet. A layer thickness regulation member (blade) regulates the layer thickness of the developer on the developing sleeve 41. The developer is then conveyed to a developing region on the facing photosensitive drum 1 via the developing sleeve 41 rotated by a developing sleeve driving means 44.

A development bias power supply (not shown) applies, to the developing sleeve 41, a development bias voltage (oscillation voltage) obtained by superposing an AC voltage on a negative DC voltage Vdc. In response to this, the negatively charged toner is transferred to an electrostatic image on the photosensitive drum 1 which is positively charged much more than the developing sleeve 41, reversely developing the electrostatic image.

In a developer replenishment device 30, the toner replenishment bath 33 is laid out above the developing device 4 and contains a replenishment toner. The toner conveyance screw 32 driven to rotate by a motor 31 is arranged below the toner replenishment bath 33.

The toner conveyance screw 32 supplies the replenishment toner in the toner replenishment bath 33 into the developing device 4 through a toner conveyance path including the toner conveyance screw 32. The CPU 111 of the control unit 110 controls toner supply by the toner conveyance screw 32 by controlling rotation of the motor 31 via a motor driving circuit (not shown). The RAM 112 connected to the CPU 111 stores control data and the like to be supplied to the motor driving circuit. The toner replenishment bath 33, motor 31, toner conveyance screw 32, and the like form the developer replenishment device 30.

The developing device 4 incorporates a toner density sensor 14 as a toner density detection means to detect the toner density of the two-component developer.

The toner density sensor 14 is laid out in contact with the developer circulating within the developing device 4. The toner density sensor 14 includes a driving coil, reference coil, and detection coil (none are shown), and outputs a signal corresponding to the permeability of the developer. Upon applying a high-frequency bias to the driving coil, the output bias of the detection coil changes in accordance with the toner density of the developer. The output bias of the detection coil is compared with that of the reference coil which does not contact the developer, thereby detecting the toner density of the developer at this moment.

The control unit 110 converts the result of detection by the toner density sensor 14 into a toner density using a conversion equation defined in advance. In the embodiment, the CPU 111 obtains the toner density T/D of the developer in the developing device 4 based on the result of measurement by the toner density sensor 14 according to equation (1):

$$T/D=(\text{SGNL value}-\text{SGNL}i\text{ value})/\text{Rate}+\text{initial } T/D \quad (1)$$

SGNL value: value measured by the toner density sensor

SGNLi value: initial value measured by the toner density sensor (initial value)

Rate: sensitivity

In equation (1), the initial T/D and SGNLi value are those measured in initial setting, and Rate is obtained by measuring in advance the sensitivity of ΔSGNL to T/D as the characteristic of the toner density sensor 14. These constants (initial T/D, SGNLi value, and Rate) are stored in the storage unit (for example, RAM 112) of the control unit 110.

[Toner Replenishment]

In the embodiment, the toner replenishment amount is calculated by the following method. In the image forming apparatus 100 the toner density of the developer in the developing device 4 decreases along with continuous development of an electrostatic image on the photosensitive drum 1. The control unit 110 controls the toner density of the developer to be as constant as possible and the image density to be as constant as possible by executing toner replenishment control to replenish the developing device 4 with the toner from the toner replenishment bath 33. The image forming apparatus 100 forms an electrostatic image on the photosensitive drum 1 digitally by area coverage modulation. Thus, the toner replenishment operation is done based on the detection result of a patch image by an image density sensor 12 and a digital image signal for each pixel of an electrostatic image to be formed on the photosensitive drum 1.

More specifically, the control unit 110 (first control unit) calculated a replenishment toner amount Msum per image forming sheet by adding a toner replenishment amount Mp obtained by patch detection ATR (Automatic Toner Replenishment) (to be described later) to a toner replenishment amount Mv obtained by video count ATR (to be described later). In the embodiment, the replenishment toner amount Msum to be currently supplied to the developing device 4 is set by adding an actual toner shortage amount (toner replenishment amount Mp) detected from a patch image to a toner consumption amount (toner replenishment amount Mv) predictively calculated in accordance with an image, based on equation (2):

$$Msum = Mv + (Mp/\text{patch detection ATR frequency}) \quad (2)$$

Mv: replenishment toner amount obtained by video count ATR

Mp: replenishment toner amount obtained by patch detection ATR

[Video Count ATR]

The video count ATR will be explained as a method of controlling the toner density by calculating a necessary toner replenishment amount from the output level of an image signal for each pixel in an image that is obtained from a video counter 220. The toner replenishment amount (reference replenishment amount)

My obtained by the video count ATR used in equation (2) is obtained from an image signal obtained by the image reading unit (reader unit) A or an image signal sent from a computer or the like. A circuit arrangement which processes the image signal is shown in the block diagram of FIG. 2.

As shown in FIG. 2, image signals M2, C2, Y2, and K2 output from the masking & UCR circuit 208 are sent to even the video counter 220. The video counter 220 integrates the image density values of respective pixels to calculate the video count values of C, M, Y, and K images.

The video counter 220 processes the image signals M2, C2, Y2, and K2, and integrates the density values of respective pixels to calculate the video count values of C, M, Y, and K color images. For example, when forming a 128-level half-tone image at 600 dpi and A3 full size (16.5×11.7 inch), the video count value is "128×600×600×16.5×11.7=8895744000".

The video count value is converted into the reference replenishment amount Mv using a table which is obtained in advance, stored in the ROM 113, and indicates the relationship between the video count value and the replenishment toner amount. In every image formation, the reference replenishment amount Mv of each image is calculated.

[Patch Detection ATR]

Figure 5:
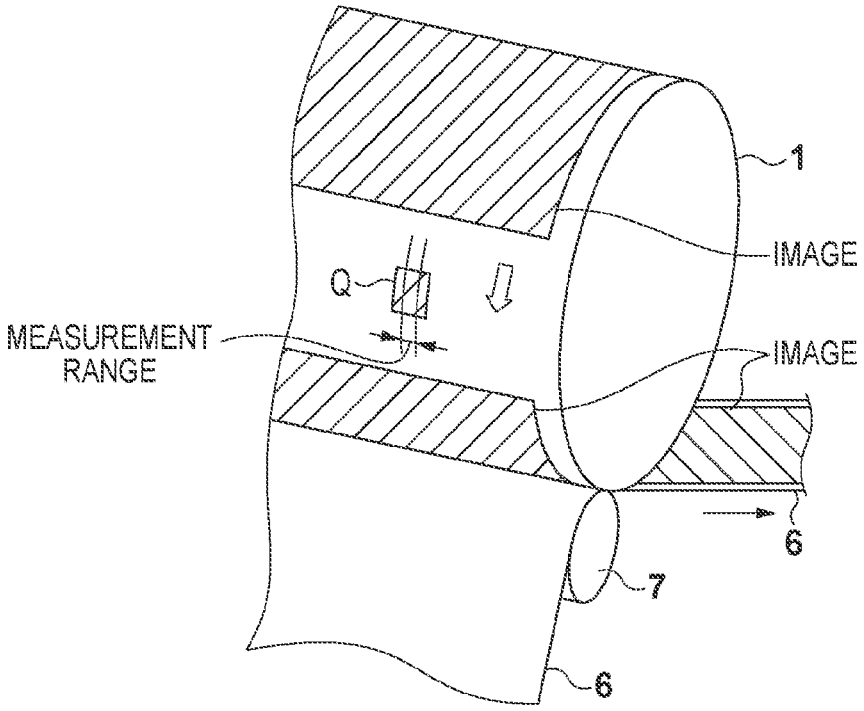
FIG. 5 is a view for explaining a patch image formation process.
Figure 6:
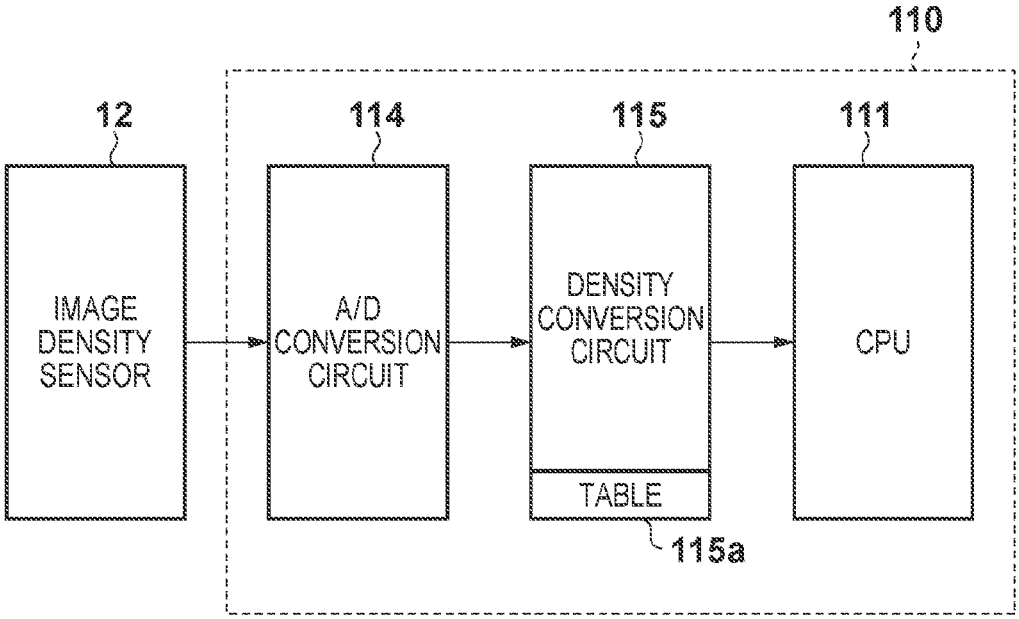
FIG. 6 is a block diagram for explaining a patch density measurement process.
Figure 7:
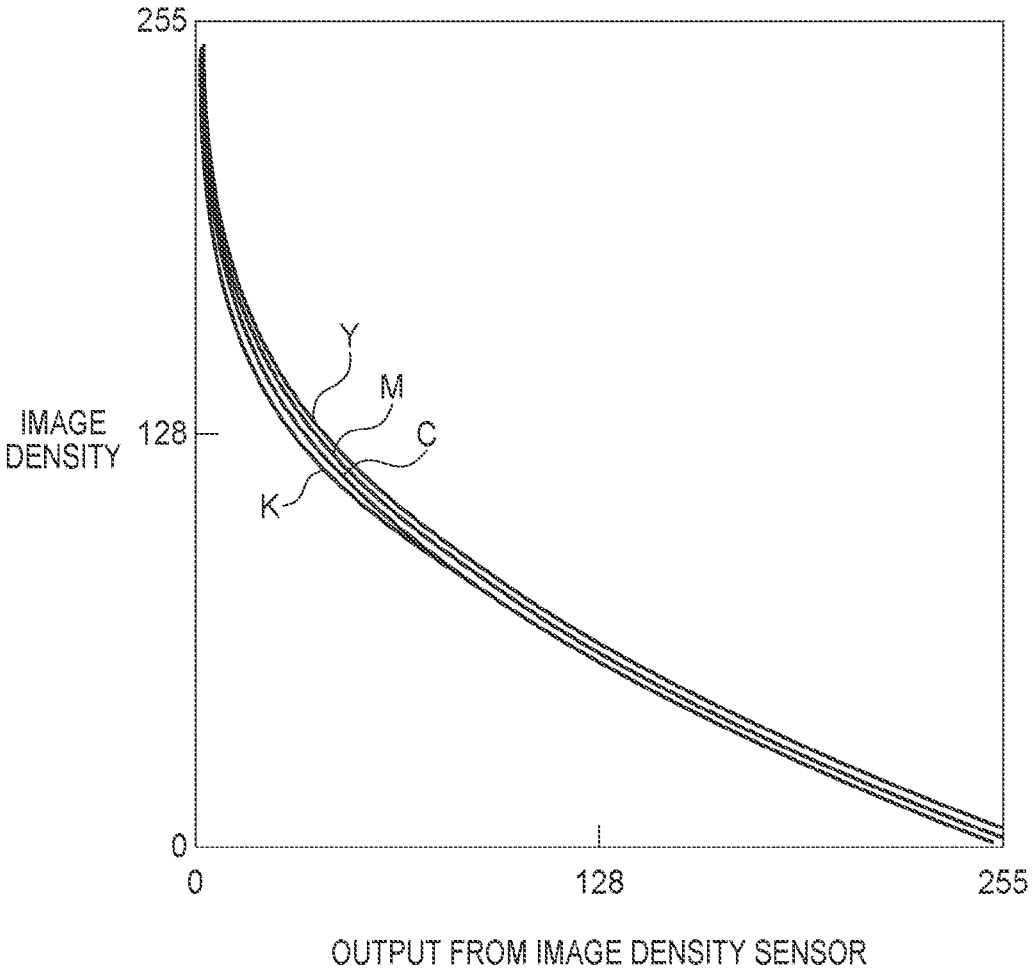
FIG. 7 is a graph for explaining the relationship between the image density and the photosensor output.

The patch detection ATR will be explained as a method of controlling the toner density by detecting the density of a formed patch. FIG. 5 is a view for explaining a patch image formation process. FIG. 6 is a block diagram for explaining a patch density measurement process. FIG. 7 is a graph for explaining the relationship between the image density and the photosensor output.

As a detailed operation for the photosensitive drum 1 in FIG. 4, the control unit 110 forms a patch image at an image interval for every predetermined number of formed images in continuous image formation, as shown in FIG. 5. During continuous image formation, a patch image Q is formed as an image density detection image pattern in a non-image region (image interval) between the trailing end of every 24th image to be output and the leading end of the next image. Thus, the patch image Q is formed in the non-image region for every 24 images in continuous image formation. Note that the number of images is 24 in the embodiment, but is not limited to this.

The control unit 110 controls the exposure device 3 to write a "patch electrostatic image" as the electrostatic image of a patch image on the photosensitive drum 1, and the developing device 4 to develop it and form the patch image Q. The control unit 110 executes density control by the patch detection ATR, and performs toner replenishment control based on the detection result of the patch image Q by the image density sensor 12 so that the image density of the patch image Q converges to the reference density.

The printer control unit 109 includes a patch image signal generation circuit (pattern generator) 192 which generates a patch image signal of a signal level corresponding to a predetermined image density. The pattern generator 192 supplies the patch image signal to a pulse width modulation circuit 191, and the pulse width modulation circuit 191 generates a laser driving pulse having a pulse width corresponding to the predetermined density. The pulse width modulation circuit 191 supplies the generated laser driving pulse to the semiconductor laser of the exposure device 3. The semiconductor laser emits light for a time corresponding to the pulse width, scanning and exposing the photosensitive drum 1. Accordingly, the patch electrostatic image corresponding to the predetermined density is formed on the photosensitive drum 1. The developing device 4 develops the patch electrostatic image.

The image density sensor (patch detection ATR sensor) 12 for detecting the image density of the patch image Q is laid out downstream of the developing device 4 to face the photosensitive drum 1. The image density sensor 12 includes a light-emitting portion 12*a* having a light-emitting element such as an LED, and a light-receiving portion 12*b* having a light-receiving element such as a photodiode (PD). The light-receiving portion 12*b* is configured to detect only specular reflection by the photosensitive drum 1.

The image density sensor 12 measures the quantity of light reflected by the photosensitive drum 1 at the timing when the patch image Q between images passes by the image density sensor 12. A signal regarding the measurement result is input to the CPU 111.

As shown in FIG. 6, light (near infrared light) which is reflected by the photosensitive drum 1 and enters the image density sensor 12 is converted into an electrical signal. An A/D conversion circuit 114 in the control unit 110 converts an analog electrical signal of 0 to 5 V output from the image density sensor 12 into an 8-bit digital signal. A density conversion circuit 115 in the control unit 110 converts the digital signal into density information.

As shown in FIG. 7, when the image density of the patch image Q formed on the photosensitive drum 1 changes stepwise by area coverage modulation, an output (analog electrical signal) from the image density sensor 12 changes in accordance with the density of the formed patch image Q. Assume that an output from the image density sensor 12 is 5 V at level of 255 when no toner is attached to the photosensitive drum 1.

As the area coverage by the toner on the patch image Q formed on the photosensitive drum 1 increases and the image density rises, an output from the image density sensor 12 decreases. Each color-specific table 115*a* is prepared in advance to convert an output from the image density sensor 12 into a density signal of each color based on this characteristic of the image density sensor 12. The table 115*a* is stored in the storage unit of the density conversion circuit 115. The density conversion circuit 115 can read a patch image density at high precision for each color. The density conversion circuit 115 outputs density information to the CPU 111.

The image density sensor 12 has a log function characteristic. As the image density increases, the detection result (output from the image density sensor 12) less changes, resulting in poor detection precision. Hence, a 2-line 1-space pattern is used to decrease the area coverage and patch image density. A patch electrostatic image formed on the photosensitive drum 1 is a 2-line 1-space image in the sub-scanning direction at a resolution of 600 dpi.

As shown in FIG. 4, the replenishment toner amount Mp by the patch detection ATR based on equation (2) described above is obtained from the difference ΔD between the measurement result and a reference value which is the detection value of the density of the patch image Q with the developer at an initial stage. For example, the change amount ΔDrate of the measurement result of the density of the patch image Q upon deviation of the toner in the developing device 4 from the reference value by 1 g (reference amount) is obtained in advance and stored in the storage unit (for example, ROM 113). In the embodiment, the CPU 111 calculates the replenishment toner amount Mp by the patch detection ATR using equation (3):

$$Mp=\Delta D/\Delta D\text{rate} \tag{3}$$

To avoid abrupt tint variations, toner replenishment by the replenishment toner amount Mp is desirably performed within the patch detection ATR execution interval as averagely as possible. That is, it is desirable to supply a necessary toner not abruptly but stepwise within the execution interval. If the toner is supplied at once by the obtained replenishment toner amount Mp in formation of the first image after executing the patch detection ATR, excessive toner replenishment control may be done, generating an overshoot. To prevent this, equation (3) divides the replenishment toner amount Mp by the patch detection ATR execution frequency to uniformly divide the replenishment toner amount Mp within the patch detection ATR execution interval and perform toner replenishment.

In this way, the CPU 111 of the control unit 110 obtains the replenishment toner amount Msum in accordance with equation (2). The CPU 111 then controls the motor 31 to operate the toner conveyance screw 32, replenishing the developing vessel 45 with the toner by the replenishment toner amount Msum from the toner replenishment bath 33.

[Toner Charge Amount]

A method of obtaining the current toner charge amount will be described with reference to the block diagram of FIG. 4 and the flowchart of FIG. 8. The control unit 110 calculates the toner charge amount. The control unit 110 includes the RAM 112 serving as a work buffer used for calculation based on each signal, the CPU 111 for executing calculation, and the ROM 113 including a table necessary for calculation.

In the embodiment, the toner charge amount Q/M (μC/g) is always calculated in every minute. When the image forming apparatus 100 is turned on from the OFF state, the toner charge amount Q/M is calculated at once by a corresponding number of times. For example, when the image forming apparatus 100 is turned on after 1 h, calculation in steps S1 to S8 is executed 60 times.

In step S1, when calculating the toner charge amount Q/M of the nth image, the control unit 110 acquires various data during 1 min after calculating the toner charge amount Q/M of the (n−1)th image. Various information includes the following ones. First, the integrated value of the video count for 1 min is acquired from the video counter 220. The video count value is very large, so a value obtained by dividing it by 2^24 is used for convenience (X^Y indicates the Yth power of X). The obtained value is defined as a video count V. Second, the driving time Td (sec) of the developing sleeve 41 for 1 min is acquired from the developing sleeve driving means 44. Third, the stop time Ts (sec) of the developing sleeve 41 during 1 min is calculated. The stop time Ts is a value obtained by subtracting the driving time Td (sec) from 60 sec. Fourth, the toner density TDrate (%) is acquired from the toner density sensor 14. Fifth, the absolute moisture content H (g/kg) in the image forming apparatus 100 that is detected by a humidity/temperature sensor (not shown) attached inside the image forming apparatus 100 is acquired. Sixth, the sleeve driving integrated time Tt (min) serving as the integrated value of the driving time Td (sec) of the developing sleeve 41 after exchange of the developer is acquired from the developing sleeve driving means 44.

In step S2, the control unit 110 calculates the image ratio D (%) from equation (4):

$$\text{image ratio } D=V/Td\times 0.162 \tag{4}$$

V: video count value

Td: driving time

The image ratio D indicates the amount of image formed during the sleeve driving time. The coefficient "0.162" used in equation (4) should be optimized for each image forming apparatus. However, assuming that the coefficient is optimized for an image forming apparatus which outputs 70 A4-size sheets in every minute, the embodiment adopts the coefficient "0.162" for calculation. By optimization, the average value of the image ratio per sheet becomes equal to the calculated value. Note that another value may be used on the assumption that another sheet size is used frequently.

Figure 9:
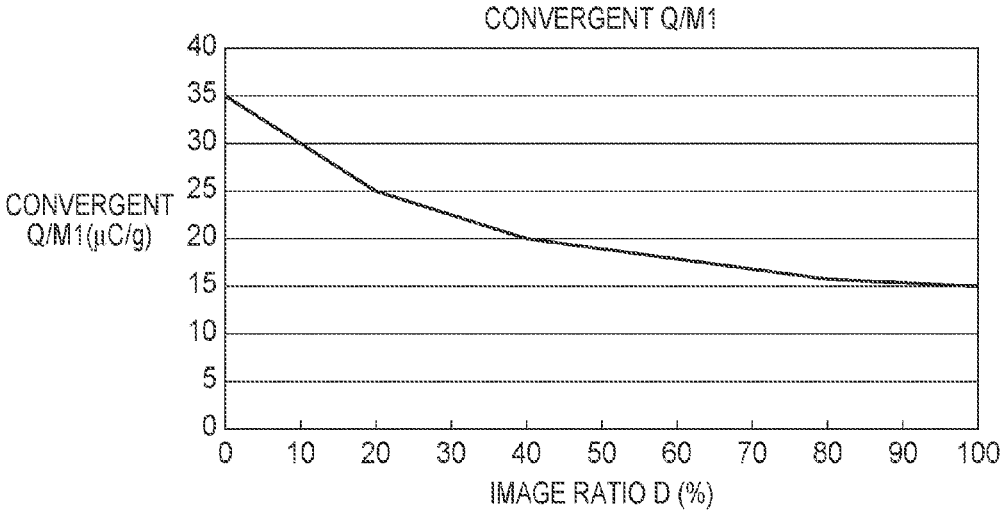
FIG. 9 is a graph showing a relationship to calculate a convergent Q/M1 from the image ratio.

In step S3, the control unit 110 calculates a convergent Q/M1. The convergent Q/M1 is calculated from the image ratio D using the relationship in FIG. 9. The convergent Q/M1 indicates the value of a toner charge amount which converges when image formation is performed permanently (infinite time) at the image ratio D (%). In step S4, the control unit 110 calculates a convergent Q/M2 (μC/g) from equation (5):

$$\text{convergent } Q/M2=\text{convergent } Q/M1\times(-0.1\times TD\text{rate}+1.8) \tag{5}$$

The toner charge amount Q/M changes depending on even the toner density and thus is corrected by the toner density.

The relation given as equation (5) changes depending on the developer material and the like and is not limited to the above equation. In general, Q/M tends to be lower as the toner density increases, and higher as it decreases. Considering this characteristic, another relation may be defined.

In step S5, the control unit 110 calculates a convergent Q/M3 (μC/g) from equation (6):

$$\text{convergent } Q/M3 = \text{convergent } Q/M2 + 5 - 0.5 \times H \quad (6)$$

The toner charge amount Q/M changes depending on even the environment and is corrected by the absolute moisture content. The relation given as equation (6) changes depending on the developer material and the like and is not limited to the above equation. In general, Q/M tends to be higher as the absolute moisture content increases, and lower as it decreases. Considering this characteristic, another relation may be defined.

In step S6, the control unit 110 calculates a convergent Q/M4 (μC/g) from equation (7):

$$\text{convergent } Q/M4 = \text{convergent } Q/M3 \times (-0.000021 \times Tt + 1) \quad (7)$$

The toner charge amount Q/M changes depending on even the degree of deterioration of the developer and is corrected by the sleeve driving integrated time. The relation given as equation (7) changes depending on the developer material and the like and is not limited to the above equation. The embodiment employs equation (7) as an example of an optimum equation.

In step S7, the control unit 110 calculates a tentative Q/M (for n) from equation (8):

$$\text{tentative } Q/M\ (\text{for } n) = \alpha \times (\text{convergent } Q/M4 - Q/M(\text{for } n-1)) \times Td/60 + Q/M(\text{for } n-1)$$

$$\alpha = 0.01 \quad (8)$$

Equation (8) represents a change of the toner charge amount for 1 min during sleeve driving by a recurrence formula. This equation defines a phenomenon in which the toner charge amount Q/M converges gradually. Note that the coefficient α changes depending on the developer material and the like and is not limited to equation (8). The embodiment uses the α value as an example of an optimum value.

In step S8, the control unit 110 calculates Q/M (for n) from equation (9), thereby calculating the toner charge amount Q/M (μC/g) at this time:

$$Q/M(\text{for } n) = -\beta \times Ts/60 \times \text{tentative } Q/M(\text{for } n) + \text{tentative } Q/M(\text{for } n)$$

$$\beta = 0.001 \quad (9)$$

Equation (9) represents a change of the toner charge amount for 1 min during sleeve stop by a recurrence formula. This equation defines a phenomenon in which the toner charge amount of the two-component developer decreases gradually and comes close to "0". Note that the coefficient β changes depending on the developer material and the like and is not limited to the above equation. The embodiment uses the β value in equation (9) as an example of an optimum value.

As described above, by executing this sequence in every minute, the toner charge amount Q/M (μC/g) can be calculated in every minute.

Figure 8:
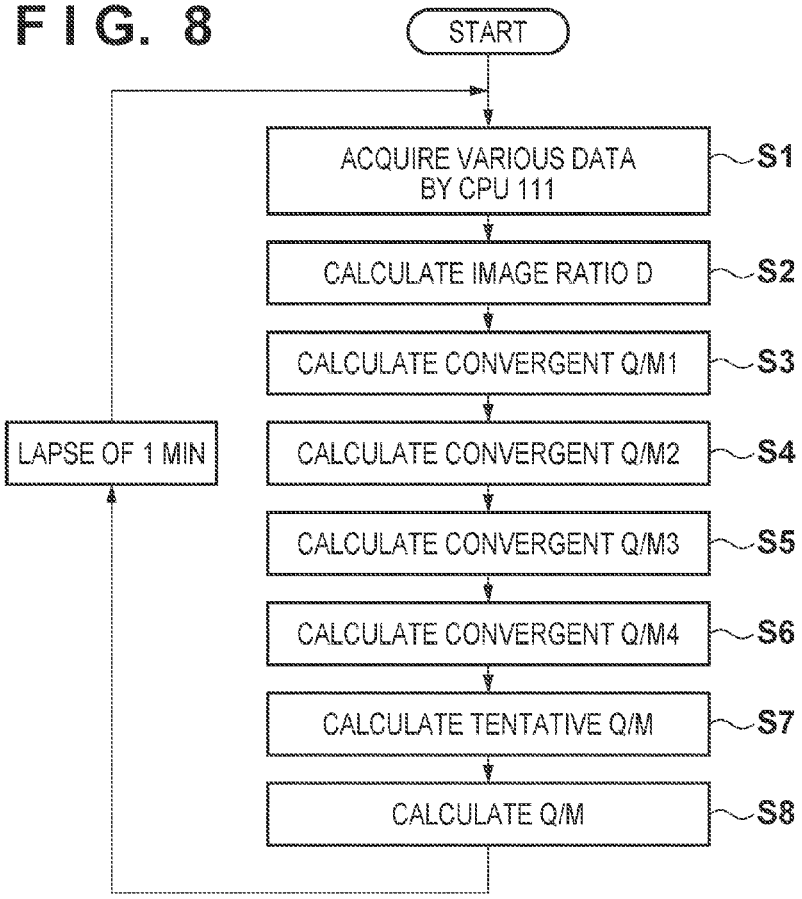
FIG. 8 is a flowchart showing a sequence to calculate the toner charge amount.

Note that the execution cycle of the processing sequence shown in FIG. 8 is 1 min in the embodiment, but is not limited to this. For example, the processing sequence may be performed once in a longer cycle in consideration of the processing load. The execution cycle may be set by taking account of the toner characteristic.

[Development Efficiency]

Figure 10:
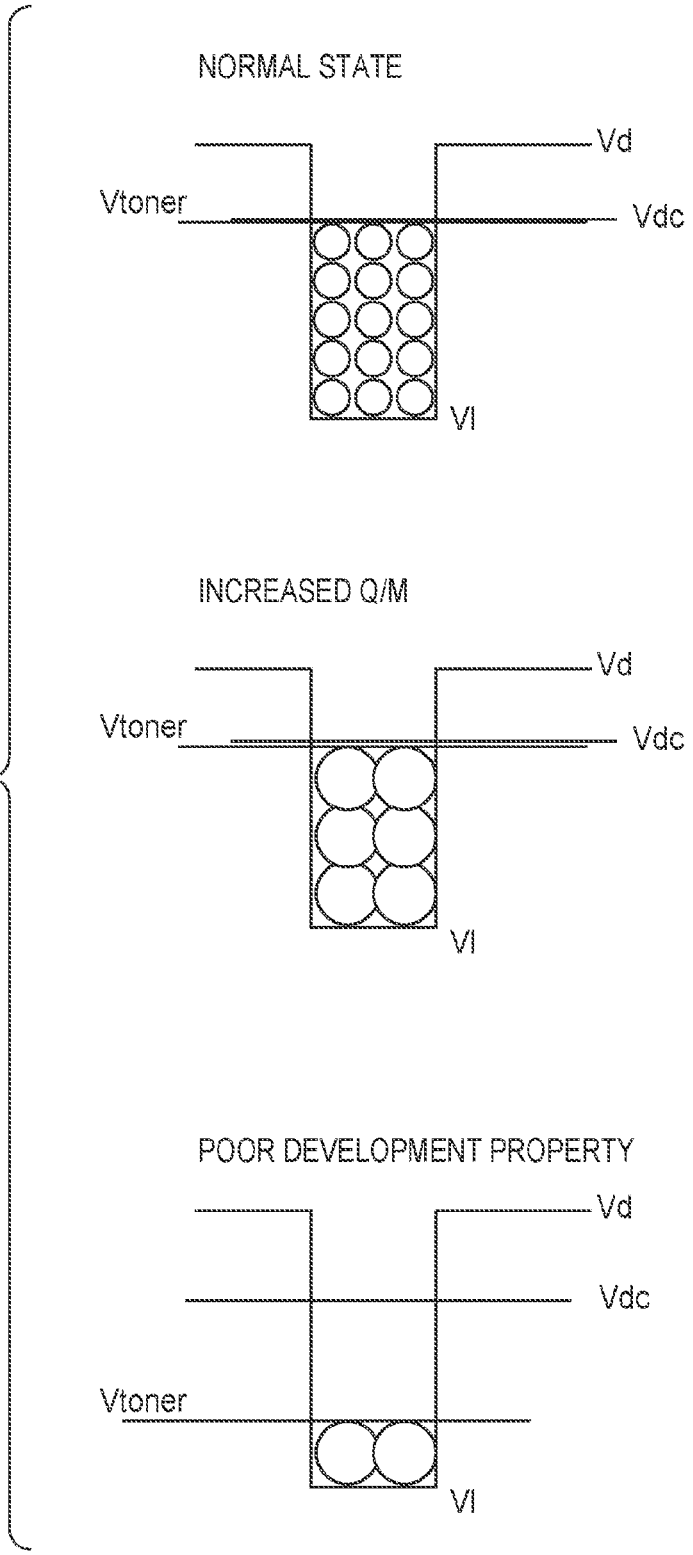
FIG. 10 is a schematic view showing the potential of a photosensitive drum 1 for explaining the development efficiency.

FIG. 10 is a schematic view showing the potential of the photosensitive drum 1. The potential is indicated by an absolute value. FIG. 10 shows a state immediately after the above-described charging, exposure, and development processes. In FIG. 10, Vd is a dark-portion potential (potential of an unexposed portion). As described above, Vdc is a negative DC voltage applied to the developing sleeve 41. Vl is a bright-portion potential (potential of an exposed portion). The toner is applied to this portion in the development process.

The toner moves to the photosensitive drum 1 in accordance with the potential difference between Vl and Vdc. Upon development, the potential at the Vl portion rises because of toner charges and finally reaches Vdc. Vtoner is the potential of the toner layer after development. When Vtoner reaches Vdc, the potential difference is canceled, and development ends. Note that a figure "○" shown in FIG. 10 represents the toner. The size of the figure "○" schematically represents the toner charge amount, and the number of "○"s schematically represents the number of toner particles applied to the photosensitive drum 1. The development efficiency is given by equation (10):

$$\text{development efficiency} = (V\text{toner} - Vl)/(Vdc - Vl) \times 100\ (\%) \quad (10)$$

As described above, Vtoner≈Vdc in general, so the development efficiency is almost 100%. Even when Q/M rises, that is, the toner charge amount in the two-component developer increases, the development efficiency is still almost 100% as long as Vtoner≈Vdc holds, as shown in FIG. 10. However, the toner amount capable of development decreases because the toner charge amount is large, that is, the size of the figure "○" shown in FIG. 10 is large. Hence, the toner amount and toner charge amount after development have an inversely proportional relationship as long as the development efficiency is constant.

To the contrary, when the development property deteriorates, the development process ends before Vtoner reaches Vdc. Since Vtoner is lower than Vdc, the development efficiency given by equation (10) becomes lower than 100%. In this state, no toner charge amount can be obtained from the toner amount unless the value of the development efficiency is considered.

The potential of the photosensitive drum 1 is regarded as a capacitor model. Letting Q be the total toner charge amount and C be the toner capacitance, the potential difference is given by equation (11) because the toner capacitance raises the potential:

$$V\text{toner} - Vl = Q/C \quad (11)$$

Since the capacitance C is uniquely determined by the type of toner, equation (12) holds regardless of whether the development property deteriorates:

$$Q/(V\text{toner} - Vl) = \text{constant} \quad (12)$$

Further, letting Q' be the total toner charge amount when the developer is in a given state, Vtoner' be the toner layer potential, and Vl' be the bright-portion potential, equation (13) holds:

$$Q/(V\text{toner} - Vl) = Q'/(V\text{toner}' - Vl') \quad (13)$$

Letting α (%) be the development efficiency when the developer is in a given state, equation (14) holds:

$$(V\text{toner}' - Vl')/(Vdc - Vl) = \alpha \quad (14)$$

Equations (13) and (14) yield equation (15):

$$\text{development efficiency} = (V\text{toner} - Vl)/(Vdc - Vl) \times 100\ (\%) = Q/Q' \times \alpha(\%) \quad (15)$$

From this, the development efficiency can be calculated from the ratio of the total toner charge amount.

In the embodiment, a development efficiency in an initial state in which no developer deteriorates is defined as 100%, and a development efficiency is calculated based on a ratio from the initial one.

[Image Formation Processing]

Figure 11:
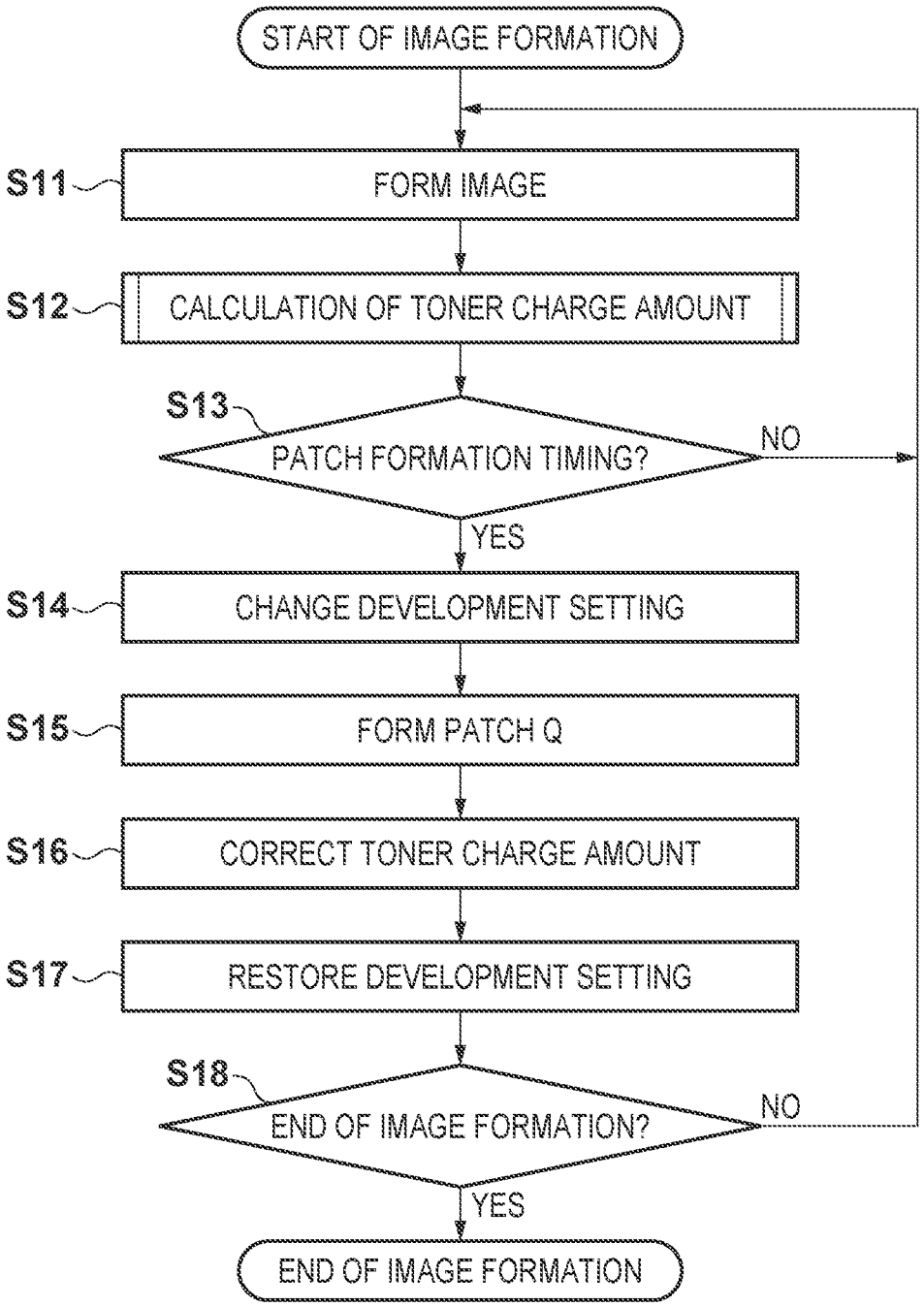
FIG. 11 is a flowchart showing formation of a patch for correcting the toner charge amount based on the patch.

FIG. 11 shows a processing sequence regarding image formation. Image formation processing includes processing of performing observer correction for the above-mentioned toner charge amount calculation value. In the embodiment, assume that the control unit 110 controls various processes in this processing.

After the start of image formation, the control unit 110 forms an image in step S11. In step S12, the control unit 110 calculates the toner charge amount in every minute, as described with reference to FIG. 8. In step S13, the control unit 110 determines whether the aforementioned patch detection ATR timing (every 24 images) has come. If the patch detection ATR timing has come (YES in step S13), the control unit 110 changes the development setting in step S14.

More specifically, in the embodiment, the peak-to-peak of the amplitude of the high-voltage component of the development bias is raised from 1.75 kV to 2.0 kV. Then, in step S15, the control unit 110 forms the patch Q. In the patch detection ATR, the toner replenishment amount is controlled. In this control, even the toner charge amount is corrected using the detection result of the patch Q. In the patch detection ATR, therefore, both the toner replenishment amount and toner charge amount are corrected. Correction of the toner charge amount uses the absolute value of the density of the patch image Q. In the image forming apparatus 100, equation (16) holds in terms of this correction:

$$\text{toner charge amount } (\mu C/g) = 20/\text{density of patch image } Q \quad (16)$$

Figure 12:
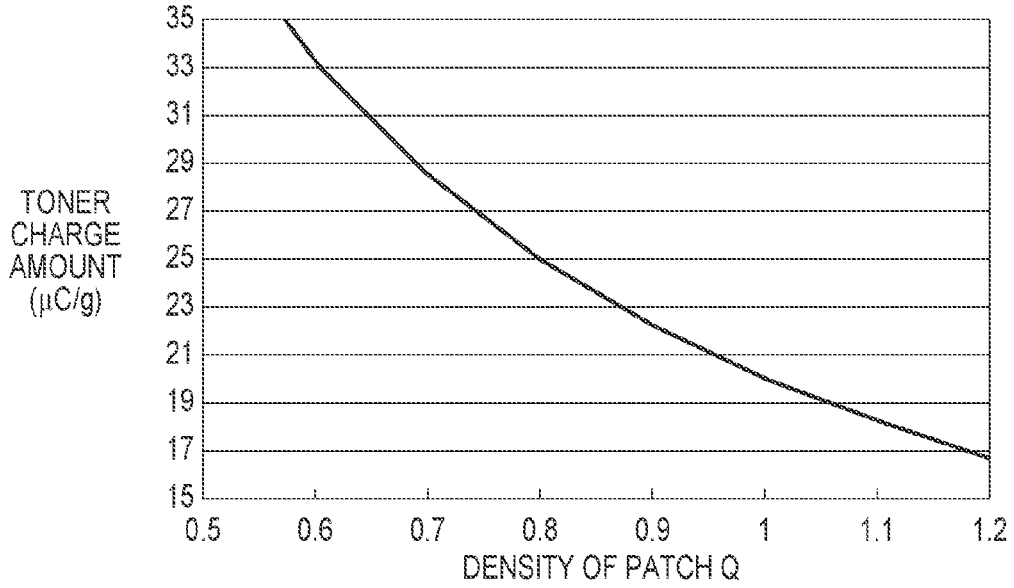
FIG. 12 is a graph showing the relationship between the density of the patch Q and the toner charge amount.

FIG. 12 shows the relationship between the toner charge amount and the density of the patch Q in equation (16).

Based on equation (16), the toner charge amount is calculated from the density of the patch Q. That is, Q/M (for n) calculated from equation (9) is corrected using the toner charge amount calculated from equation (16). In step S16, the control unit 110 corrects the toner charge amount. In the embodiment, Q/M (for n) is corrected based on equation (17):

$$\text{corrected } Q/M = ((Q/M \text{ calculated from equation (9)}) + ((Q/M \text{ calculated from density of patch } Q \text{ (equation (16))})/2 \quad (17)$$

The corrected Q/M is used in subsequent control. Even Q/M (for n−1) used in equation (8) is the corrected Q/M value derived from equation (17).

In step S17, the control unit 110 returns, to 1.75 kV, the peak-to-peak of the amplitude of the high-voltage component of the development bias that has been changed in step S14. In this manner, a proper toner charge amount can be calculated. If the control unit 110 determines in step S18 that image formation has ended (YES in step S18), the processing sequence ends. If the patch formation timing has not come (NO in step S13) or no image formation has ended (NO in step S18), the control unit 110 returns to step S11 to continue the processing.

[Development Setting]

Figure 13:
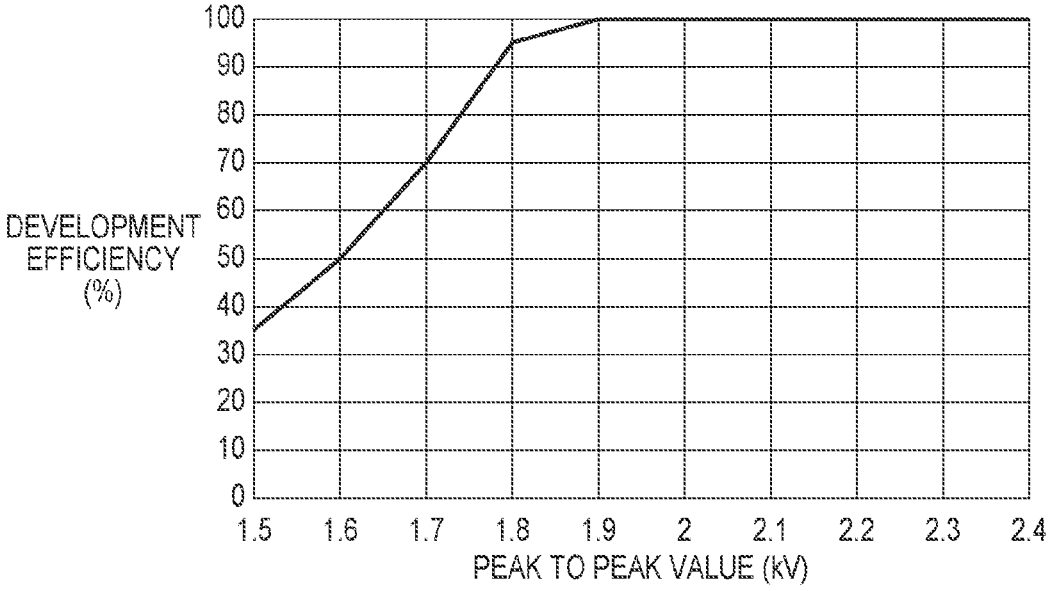
FIG. 13 is a graph showing the relationship between the peak-to-peak of the development setting and the development efficiency.

In the embodiment, the peak-to-peak value of the amplitude of the high-voltage component of the development bias is raised from 1.75 kV to 2.0 kV, but the present invention is not limited to this. It is important to set the development efficiency at almost 100%. In this state, the toner charge amount can be properly calculated from the density of the patch Q. FIG. 13 shows the relationship between the peak-to-peak value of the amplitude of the high-frequency component of the development bias and the development efficiency in the embodiment.

As is apparent from FIG. 13, the development efficiency reaches 100% at 1.9 kV or more. Hence, the peak-to-peak is desirably set to 1.9 kV or more. This relationship is obtained under the condition that 30,000 sheets have passed at an image ratio of 0%. An external additive is added to the toner, and its fine particles decrease the contact area between toner particles and that between the toner and the carrier, decreasing the adhesive force between them. However, when sheets pass successively at an image ratio low enough not to supply the toner, the external additive may liberate from the toner or be embedded in the toner. In this state, the contact area between toner particles and that between the toner and the carrier increase, and thus the contact force between the toner and the carrier increases. The toner and carrier are then hardly able to separate from each other, impairing the development property. Even in this state, the development setting is desirably made so that the development efficiency can be maintained at 100%.

However, the peak-to-peak value of the amplitude of the high-voltage component of the development bias cannot be always set high because, if the amplitude is excessively large, a small leak may occur from the developing sleeve 41 to the photosensitive drum 1 through the carrier lower in resistance than the toner and an image defect may be generated. Such a leak is recognized as an image defect by the user but is not so influential as to detect the density of the patch Q.

[Correction of Laser Beam Quantity]

Figure 14:
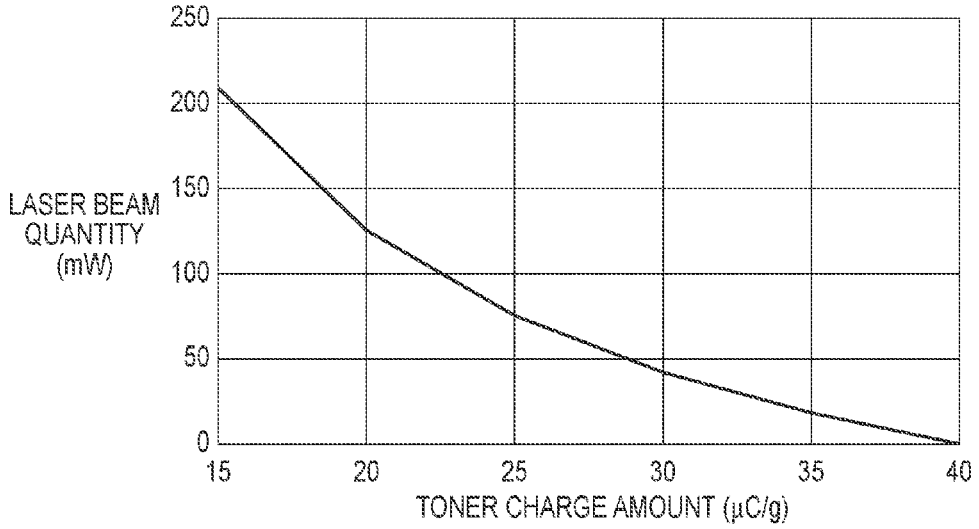
FIG. 14 is a graph showing the relationship between the toner charge amount and the laser beam quantity.

Correction of the laser beam quantity will be explained with reference to FIG. 4 which is a block diagram of the control system. Based on the toner charge amount obtained properly in the above-described way, the control unit 110 controls the laser beam quantity control circuit 190 to control the laser beam quantity. More specifically, the laser beam quantity is controlled using a difference from the reference which is a toner charge amount calculated immediately after power-on. FIG. 14 shows the relationship for obtaining the laser beam quantity from the toner charge amount. The laser beam quantity in FIG. 14 is obtained from a toner charge amount attained after power-on. Control is performed using this laser beam quantity value as a reference.

For example, as shown in FIG. 14, the reference laser beam quantity is 75 mW for a toner charge amount of 25 (μC/g) after power-on. If a toner charge amount obtained at a given timing is 20 (μC/g), the laser beam quantity is 125 mW. At this time, the difference from the reference is 50 mW. Therefore, the laser beam quantity correction value based on the toner charge amount is 50 mW. In the embodiment, after power-on, the laser beam quantity is obtained based on the absolute moisture content, which is known control and a detailed description of which will be omitted. The laser beam quantity is then corrected by the above control.

Figure 15:
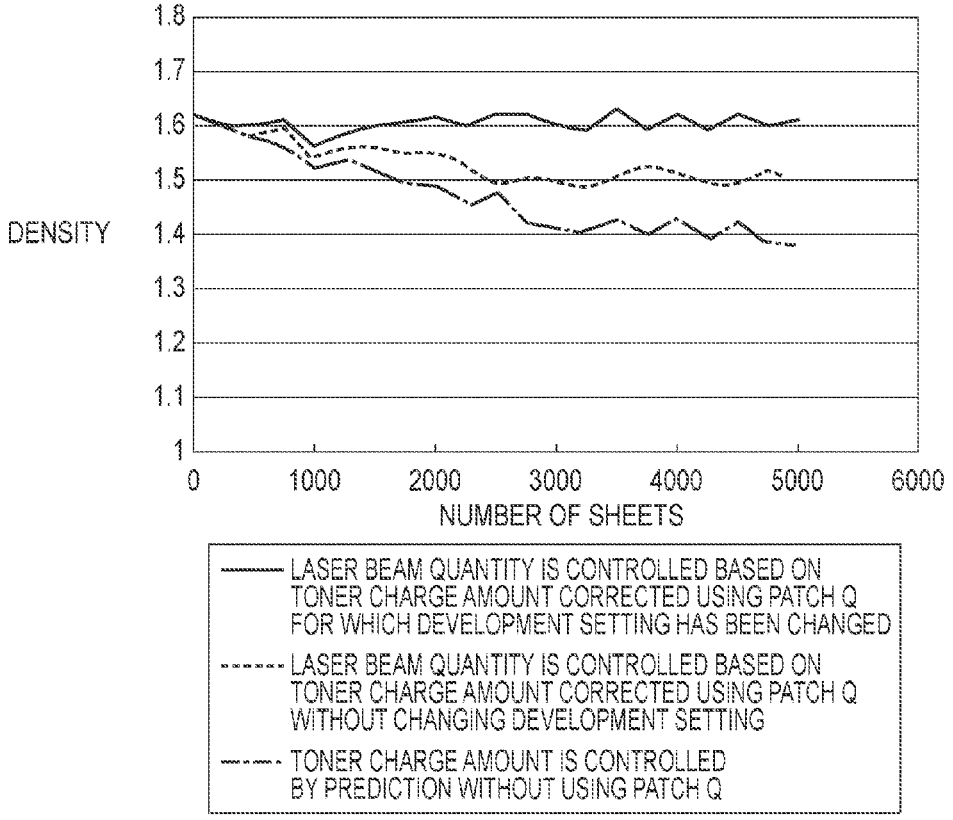
FIG. 15 is a graph for explaining the effect of control according to the first embodiment.

FIG. 15 shows the result of controlling the laser beam quantity based on a toner charge amount corrected using the patch Q for which the development setting has been changed and the result of controlling the laser beam quantity based on a toner charge amount corrected using the patch Q without changing the development setting. Note that each result shown in FIG. 15 represents a density transition when 5,000 A4-size sheets each bearing an image at an image ratio of 5% have passed successively.

The density is stabilized at almost 1.6 when the laser beam quantity is controlled based on a toner charge amount corrected using the patch Q for which the development setting has been changed. When the toner charge amount is predicted without using the patch Q, the density value becomes lowest upon passage of 5,000 sheets after the start of passage.

As shown in FIG. 15, a satisfactory density transition can be ensured by controlling the laser beam quantity based on a toner charge amount corrected using the patch Q for which the development setting has been changed according to the first embodiment.

Second Embodiment

Figure 16:
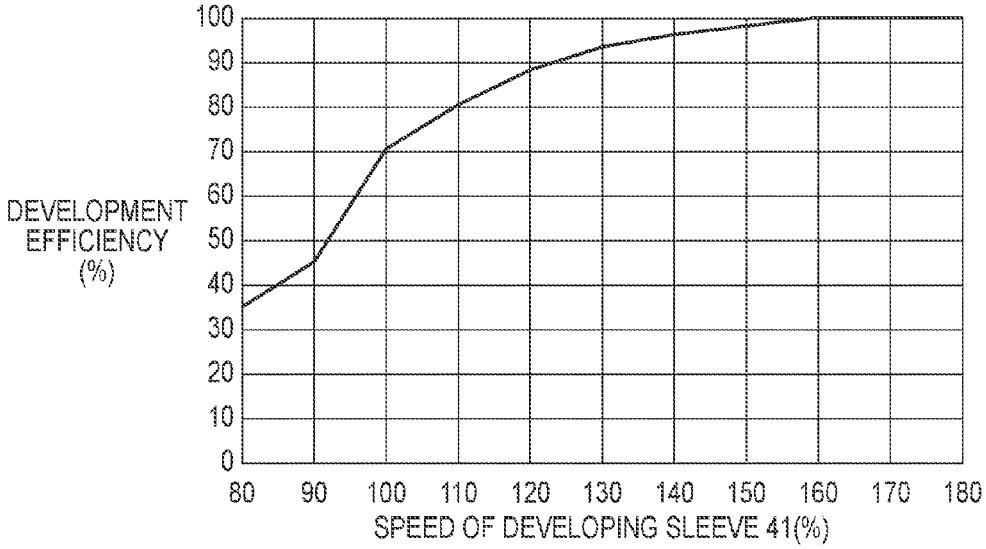
FIG. 16 is a graph showing the relationship between the speed of a developing sleeve 41 serving as the development setting and the development efficiency.

In the second embodiment, when forming a patch Q for which the development setting has been changed, not the peak-to-peak value of the development bias but the rotational speed of a developing sleeve 41 is changed. Except this, the second embodiment is the same as the first embodiment. FIG. 16 shows the relationship between the speed of the developing sleeve 41 and the development efficiency. In FIG. 16, the speed of the developing sleeve 41 is represented by the ratio of the linear speed of a photosensitive drum 1 facing the developing sleeve 41.

In normal image formation, the speed of the developing sleeve 41 is set as low as 130% to suppress deterioration of the toner. However, when forming the patch Q, the speed of the developing sleeve 41 is set to 175% because it is important that the development efficiency is almost 100%, as described above.

Figure 17:
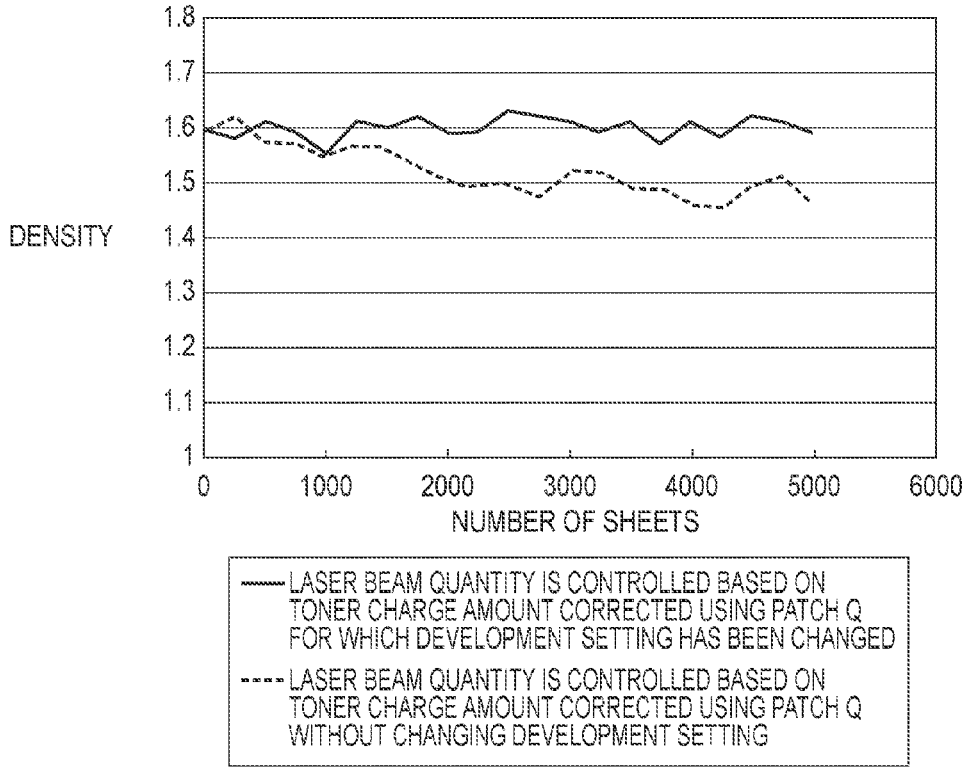
FIG. 17 is a graph for explaining the effect of control according to the second embodiment.

FIG. 17 shows the result of controlling the laser beam quantity based on a toner charge amount corrected using the patch Q for which the development setting has been changed and the result of controlling the laser beam quantity based on a toner charge amount corrected using the patch Q without changing the development setting. Each result shown in FIG. 17 represents a density transition when 5,000 A4-size sheets each bearing an image at an image ratio of 5% have passed successively. Needless to say, a value based on another size or image ratio is also available.

As shown in FIG. 17, a satisfactory density transition can be ensured even by controlling the speed of the developing sleeve 41 according to the second embodiment.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-009197, filed Jan. 19, 2011, which is hereby incorporated by reference herein in its entirety.

What is claimed is:

1. An image forming apparatus comprising:

a photosensitive member;

an exposure unit configured to expose the photosensitive member based on image data to form an electrostatic latent image on the photosensitive member;

a developing unit comprising a developing sleeve, a containing unit configured to contain a two-component developer including a toner and a carrier, and a supply unit configured to supply a bias to the developing sleeve in order that the developing sleeve carries the two-component developer contained in the containing unit, wherein the developing unit is configured to develop the electrostatic latent image using the toner carried by the developing sleeve to form an image;

a detection unit configured to detect a density of a density detection image formed by the exposure unit and the developing unit;

a prediction unit configured to predict a toner charge amount in the two-component developer;

a correction unit configured to correct the toner charge amount of the two-component developer contained in the containing unit based on the density of the density detection image detected by the detection unit;

a determination unit configured to determine an amount of exposure light by the exposure unit based on the toner charge amount corrected by the correction unit; and a control unit configured to control a predetermined bias supplied to the developing sleeve for forming the density detection image, wherein the predetermined bias is higher than a bias supplied to the developing sleeve for forming the image, and wherein the predetermined bias is a bias which is not used for forming the image.

2. The image forming apparatus according to claim 1, wherein the prediction unit predicts the toner charge amount based on the image data.

3. The image forming apparatus according to claim 1, wherein the prediction unit predicts the toner charge amount based on information about a driving status of the developing sleeve.

4. The image forming apparatus according to claim 3, wherein the information is a time during which the developing sleeve rotates.

5. The image forming apparatus according to claim 3, wherein the information is a time during which the developing sleeve is stopped.

6. The image forming apparatus according to claim 1, further comprising an output unit configured to output a signal in accordance with a toner density in the containing unit, wherein the prediction unit predicts the toner charge amount based on an output signal by the output unit.

7. The image forming apparatus according to claim 1, further comprising an obtaining unit configured to obtain an absolute moisture content of the image forming apparatus, wherein the prediction unit predicts the toner charge amount based on the absolute moisture content obtained by the obtaining unit.

* * * * *